US008144066B2

(12) United States Patent
Parsche

(10) Patent No.: US 8,144,066 B2
(45) Date of Patent: Mar. 27, 2012

(54) WIRELESS COMMUNICATIONS INCLUDING AN ANTENNA FOR WIRELESS POWER TRANSMISSION AND DATA COMMUNICATION AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 454 days.

(21) Appl. No.: 12/393,249

(22) Filed: Feb. 26, 2009

(65) Prior Publication Data

US 2010/0214177 A1 Aug. 26, 2010

(51) Int. Cl.
*H01Q 1/24* (2006.01)
*H01Q 7/00* (2006.01)

(52) U.S. Cl. ..... 343/742; 343/702; 343/743

(58) Field of Classification Search ..... 343/743, 343/741, 895, 702, 866, 867, 742, 870, 788, 343/757, 763, 764, 748, 744, 842; 340/572.7
See application file for complete search history.

(56) References Cited

U.S. PATENT DOCUMENTS

| | | | | |
|---|---|---|---|---|
| 645,576 | A | 3/1900 | Telsa | 375/259 |
| 1,892,221 | A | 12/1932 | Runge | 343/853 |
| 2,147,809 | A | 2/1939 | Alford | 250/6 |
| 5,675,346 | A | 10/1997 | Nishikawa et al. | 343/700 |
| 5,838,283 | A | 11/1998 | Nakano | 343/741 |
| 5,945,959 | A * | 8/1999 | Tanidokoro et al. | 343/728 |
| 5,977,921 | A | 11/1999 | Niccolai et al. | 343/741 |
| 2005/0110689 | A1 | 5/2005 | Masutani | 343/700 |
| 2008/0136720 | A1 | 6/2008 | Parsche et al. | 343/741 |
| 2010/0117454 | A1 * | 5/2010 | Cook et al. | 307/104 |

FOREIGN PATENT DOCUMENTS

| | | |
|---|---|---|
| EP | 0257544 | 3/1988 |
| EP | 0516303 | 12/1992 |
| WO | 00/64004 | 10/2000 |

* cited by examiner

*Primary Examiner* — Michael C Wimer
(74) *Attorney, Agent, or Firm* — Allen, Dyer, Doppelt, Milbrath & Gilchrist, P.A.

(57) ABSTRACT

The wireless communication system includes a first device, e.g. a radio frequency identification (RFID) reader, having a wireless power transmitter, a first wireless data communications unit, and a first dual polarized loop antenna having isolated signal feedpoints along a first loop electrical conductor. The wireless power transmitter transmits a power signal having a first polarization, and the first wireless data communications unit communicates using a data signal having a second polarization. A second device, e.g. an RFID tag, includes a second dual polarized loop antenna. A second wireless data communications unit communicates with the first wireless data communications unit of the first device using the data signal having the second polarization. A wireless power receiver receives the power signal having the first polarization from the wireless power transmitter of the first device, and provides power for the second device.

21 Claims, 4 Drawing Sheets

WIRELESS COMMUNICATIONS INCLUDING AN ANTENNA FOR WIRELESS POWER TRANSMISSION AND DATA COMMUNICATION AND ASSOCIATED METHODS

FIELD OF THE INVENTION

The present invention relates to the field of communications, and, more particularly, to antennas for wireless communication and related methods.

BACKGROUND OF THE INVENTION

Power requirements for modern, solid state electronics are progressively becoming lower and lower. For example, the Liquid Crystal Display (LCD) may require only milliwatts for operation, and the field effect transistor (FET) can respond to even small static charges. This has enhanced the utility of wireless power transmission as an approach for energizing electronics. An example and application of wireless power for electronics is the Radio Frequency Identification (RFID) transponder "tag", which can allow a method of storing and remotely retrieving data to a reader.

As background, wireless power transmission can be the conveyance of electrical energy by radio frequency (RF) techniques, such as the electric power transmitted and received between two radio antennas. Depending on antenna size and range of transmission, the energy may convey by far fields or by near fields, and the energy transferred weak or small. Although it may be impractical or even hazardous to convey high power over great distances, wireless power transmission can be effective, safe and reliable for lower powers and shorter ranges. Generally, the shorter the range the greater the power that can be conveyed. There is a need for wireless power that is more easily integrated with communications.

It is possible to have dual linear or dual circular polarization channel diversity. That is, a frequency may be reused if one channel is vertically polarized and the other horizontally polarized. Or, a frequency can also be reused if one channel uses right hand circular polarization (RHCP) and the other left hand circular polarization (LHCP). Polarization refers to the orientation of the E field in the radiated wave, and if the E field vector rotates in time, the wave is then said to be rotationally or circularly polarized. Orthogonal polarizations, e.g. polarizations that are perpendicular, can be vertical linear and horizontal linear or right and left hand circular, and they can be uncoupled as separate channels in communications.

The dipole antenna has been perhaps the most widely used of all the antenna types. It is of course possible however to radiate from a conductor which is not constructed in a straight line. Preferred antenna shapes are often Euclidian, being simple geometric shapes known through the ages. In general, antennas may be classified as to the divergence or curl of electric current, corresponding to dipoles and loops, and line and circle structures.

Many structures are described as loop antennas, but standard accepted, e.g. canonical, loop antennas are a circle. The resonant loop is a full wave circumference circular conductor, often called a "full wave loop". The typical prior art full wave loop is linearly polarized, having a radiation pattern that is a two petal rose, with two opposed lobes normal to the loop plane, and a gain of about 3.6 dBi. Reflectors are often used with the full wave loop antenna to obtain a unidirectional pattern.

Dual linear polarization (simultaneous vertical and horizontal polarization from the same antenna) has commonly been obtained from crossed dipole antennas. For instance, U.S. Pat. No. 1,892,221, to Runge, proposes a crossed dipole system. A dual polarized loop antenna could be more desirable however, as loops provide greater gain in smaller area. An approach to dual circular polarization in single loops is described in U.S. Published Patent Application No. 20080136720, to Parsche et. al.

U.S. Pat. No. 645,576, to Tesla, is directed to wireless power transmission. A pair of "elevated terminals" function as monopole antennas to accomplish radiation and reception of electric energy by radio. Spiral loading inductors were included to force antenna resonance. At ranges beyond $\lambda/2\pi$, operation may have been by far field radiation of electromagnetic waves, and at ranges less than $\lambda/2\pi$, the antennas radial reactive electric field (near E field) may have allowed for additional coupling. The spiral loading inductors were collocated with other windings to form a transformer in situ, to couple the generators and loads to the antennas. Connections were not however provided, to include a separate communications channel along with the power transmission.

Hybrid junctions, also known as hybrid couplers, are passive RF devices that may automatically sort and route. An example of a hybrid junction is the Branch Line Coupler, which may have four ports. When a signal is applied at port 1, it is coupled equally to ports 2 and 3 but not to port 4. Simple antennas having multiple ports with hybrid properties may be uncommon.

U.S. Pat. No. 2,147,809, to Alford describes a conjugate bridge circuit providing for isolation between selected ports connected thereto. A 90 and 180 degree phase shifts are used between ports in a transmission line ring, forming a branch line coupler. Radiation from the circuit is not however described.

U.S. Pat. No. 5,977,921 to Niccolai, et al. and entitled "Circular-polarized Two-way Antenna" is directed to an antenna for transmitting and receiving circularly polarized electromagnetic radiation which is configurable to either right-hand or left-hand circular polarization. The antenna has a conductive ground plane and a circular closed conductive loop spaced from the plane, i.e., no discontinuities exist in the circular loop structure. A signal transmission line is electrically coupled to the loop at a first point and a probe is electrically coupled to the loop at a spaced-apart second point. This antenna requires a ground plane and includes a parallel feed structure, such that the RF potentials are applied between the loop and the ground plane. The "loop" and the ground plane are actually dipole half elements to each other.

U.S. Pat. No. 5,838,283 to Nakano and entitled "Loop Antenna for Radiating Circularly Polarized Waves" is directed to a loop antenna for a circularly polarized wave. Driving power fed may be conveyed to a feeding point via an internal coaxial line and a feeder conductor passes through an I-shaped conductor to a C-type loop element disposed in spaced facing relation to a ground plane. By the action of a cutoff part formed on the C-type loop element, the C-type loop element radiates a circularly polarized wave. Dual linear, or dual circular polarization are not however provided.

Although various antennas are known for power transmission and communication they do not include isolated ports and cannot simultaneously provide the radio frequency (RF) power and communications link, e.g. diversity in the field of wireless RF identification (RFID) tags.

SUMMARY OF THE INVENTION

In view of the foregoing background, it is therefore an object of the present invention to provide data communication and power transmission between devices using a dual polarized antenna.

This and other objects, features, and advantages in accordance with the present invention are provided by a wireless communication system for data communication and power transmission. The system includes a first device, e.g. a radio frequency identification (REID) reader, having a wireless power transmitter, a first wireless data communications unit, and a first dual polarized loop antenna comprising a first loop electrical conductor and first and second isolated signal feedpoints along the first loop electrical conductor and separated by one quarter of a length of the first loop electrical conductor. The wireless power transmitter is coupled to the first isolated signal feedpoint to transmit a power signal having a first polarization, and the wireless data communications unit is coupled to the second isolated signal feedpoint to communicate using a data signal having a second polarization.

A second device, e.g. an RFID tag, for communications with the first device includes a second dual polarized loop antenna comprising a second loop electrical conductor and first and second isolated signal feedpoints along the second loop electrical conductor and separated by one quarter of a length of the second loop electrical conductor. A second wireless data communications unit is coupled to the second isolated signal feedpoint of the second dual polarized loop antenna to communicate with the first wireless data communications unit of the first device using the data signal having the second polarization. A wireless power receiver is coupled to the first isolated signal feedpoint of the second dual polarized loop antenna to receive the power signal having the first polarization from the wireless power transmitter of the first device, and to provide power for the second device.

The first and second dual polarized loop antennas may provide for simultaneous data communication and power transmission between the first and second devices. Also, the first and second isolated signal feedpoints along the loop electrical conductor of each of the first and second dual polarized loop antennas may be operated at a signal feedpoint phase angle input difference of 0 degrees. Each of the first and second isolated signal feedpoints of each of the first and second dual polarized loop antennas may define a discontinuity in the respective loop electrical conductor.

In of each of the first and second dual polarized loop antennas, the loop electrical conductor may be a circular electrical conductor. Also, each of the first and second dual polarized loop antennas may be a dual linearly polarized loop antenna.

A method aspect is directed to data communication and power transmission between first and second wireless communication devices, the method including providing the first device with a wireless power transmitter, a first wireless data communications unit, and a first dual polarized loop antenna comprising a loop electrical conductor and first and second isolated signal feedpoints along the loop electrical conductor and separated by one quarter of a length of the loop electrical conductor. The wireless power transmitter is coupled to the first isolated signal feedpoint to transmit a power signal having a first polarization, and the wireless data communications unit being coupled to the second isolated signal feedpoint to communicate using a data signal having a second polarization.

The method includes providing the second device with a second dual polarized loop antenna comprising a loop electrical conductor and first and second isolated signal feedpoints along the loop electrical conductor and separated by one quarter of a length of the loop electrical conductor. A second wireless data communications unit is coupled to the second isolated signal feedpoint of the second dual polarized loop antenna to communicate with the wireless data communications unit of the first device using the data signal having the second polarization. A wireless power receiver is coupled to the first isolated signal feedpoint of the second dual polarized loop antenna to receive the power signal having the first polarization from the wireless power transmitter of the first device, and to provide power for the second device.

The approach includes the use of isolated ports and allows simultaneous use of the radio frequency (RE) power and communications link on the same frequency or spaced apart in frequency by wireless RF identification (RFID) tags.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As discussed above, features of the present invention may apply to the field of radio frequency identification (RFID). RFID tags may be defined in three general types: passive, active, or semi-passive (also known as battery-assisted). Passive tags require no internal power source, thus being pure passive devices (they are only active when a reader is nearby to power them). Semi-passive and active tags use a power source, usually a small battery. To communicate, tags respond to queries from a tag reader.

Passive RFD tags have no internal power supply. The small electrical current induced in the antenna by the incoming radio frequency signal provides just enough power for the integrated circuit in the tag to power up and transmit a response. Most passive tags signal by backscattering the carrier wave from the reader. This means that the antenna has to be designed both to collect power from the incoming signal and also to transmit the outbound backscatter signal. The response of a passive RFID tag is not necessarily just an ID number as the tag chip may even include non-volatile memory for storing data.

Active RFID tags are much larger and have their own internal power source, which is used to power the integrated circuits and to broadcast the response signal to the reader. Communications from active tags to readers is typically much more reliable than from passive tags. Many active tags today have operational ranges of hundreds of meters, and a battery life of up to 10 years. Active tags may include larger memories than passive tags, and may include the ability to store additional information received from the reader.

Semi-passive tags are similar to active tags in that they have their own power source, but the battery only powers the microchip and does not power the broadcasting of a signal. The response is usually powered by backscattering the RF energy from the reader, where energy is reflected back to the reader as with passive tags. An additional application for the battery is to power data storage. Energy from the reader may be collected and stored to emit a response in the future.

Extending the capability of RFID to go beyond the basic capabilities of conventional RFID is desirable. For example, extending the capability may include reading at longer distances and within challenging environments, and/or storing larger amounts of data on the tag.

Figure 1:
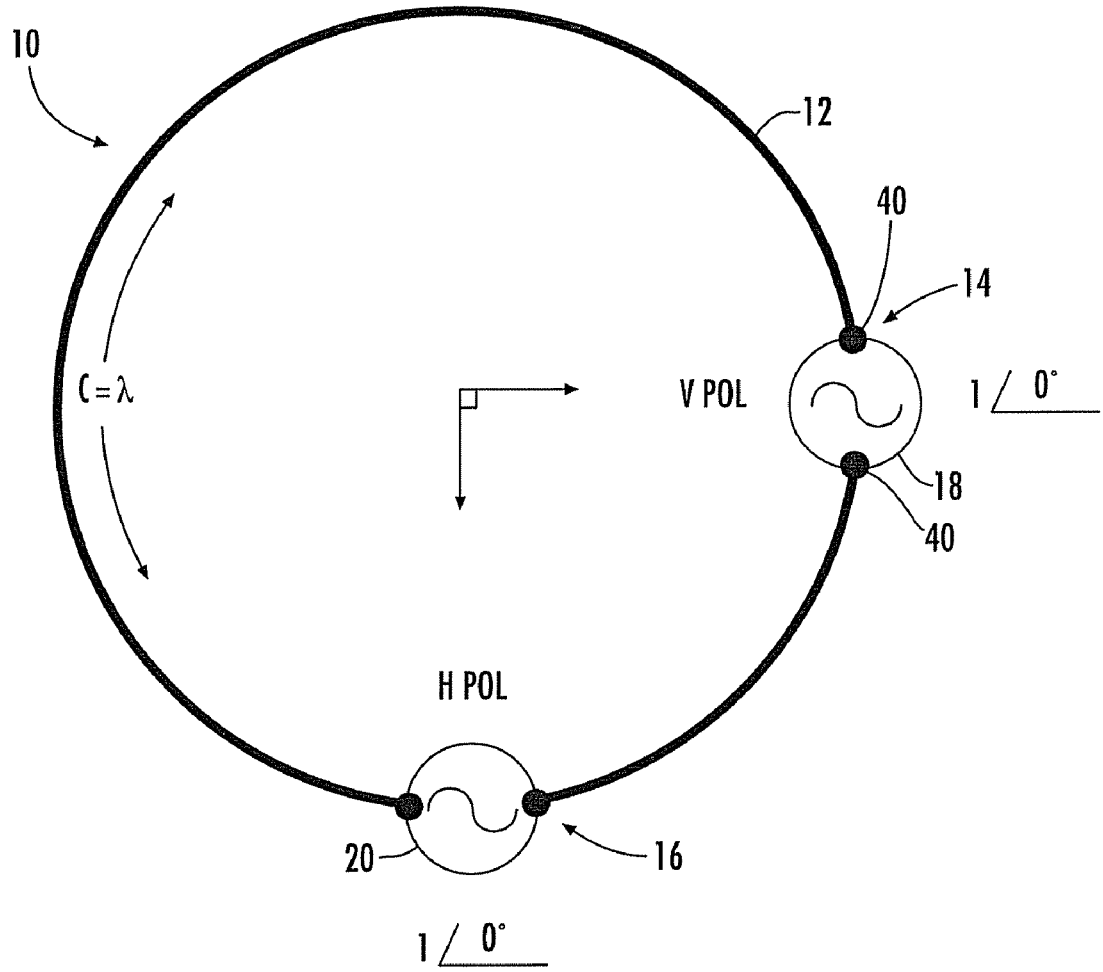
FIG. 1 is a schematic diagram of an embodiment, a dual polarized (e.g. orthogonally linearly polarized) loop antenna, in accordance with features of the present invention.

Referring initially to FIG. 1, an embodiment of the antenna for use in a wireless communication system for data communication and power transmission in accordance with features of the present embodiment will be described. The antenna is a dual polarized (e.g. operates with two orthogonal polarizations) loop antenna 10 which can provide simultaneous vertical and horizontal polarization from two isolated ports. The dual polarized loop antenna 10 is a 2-channel antenna, which can sort and multiplex two channels on the same frequency. In the dual polarized loop antenna 10, the ports (e.g. the respective orthogonal polarization ports) are isolated from one another, and are used as independent channels, for data communication and power transmission as will be discussed in further detail below.

The dual polarized loop antenna 10 includes a loop electrical conductor 12, e.g. a circular electrical conductor. The loop electrical conductor 12 may be a conductive wire, tubing, trace etc., and the circumference is preferably equal to one wavelength. Two signal feedpoints 14, 16 are along the loop electrical conductor and separated by one quarter of a length of the loop electrical conductor. One signal feedpoint 14 may be referred to as the vertical polarized port and include a signal source 18 connected in series in the loop electrical conductor 12. The other signal feedpoint 16 may be referred to as the horizontal polarized port and include a signal source 20 connected in series in the loop electrical conductor 12.

Each of the signal feedpoints 14, 16 is a series signal feedpoint and the signal sources 18, 20 coupled thereto provide the simultaneous vertical and horizontal polarization for the loop electrical conductor 12. Also, the signal feedpoints 14, 16 along the loop electrical conductor 12 of the dual polarized loop antenna 10 may be operated at a signal feedpoint phase angle input difference of 0 degrees. Each of the series signal feedpoints 14, 16 preferably defines a discontinuity in the loop electrical conductor 12. Each of the signal feedpoints 14, 16 may have two terminals 40 to form a port.

Figure 2:
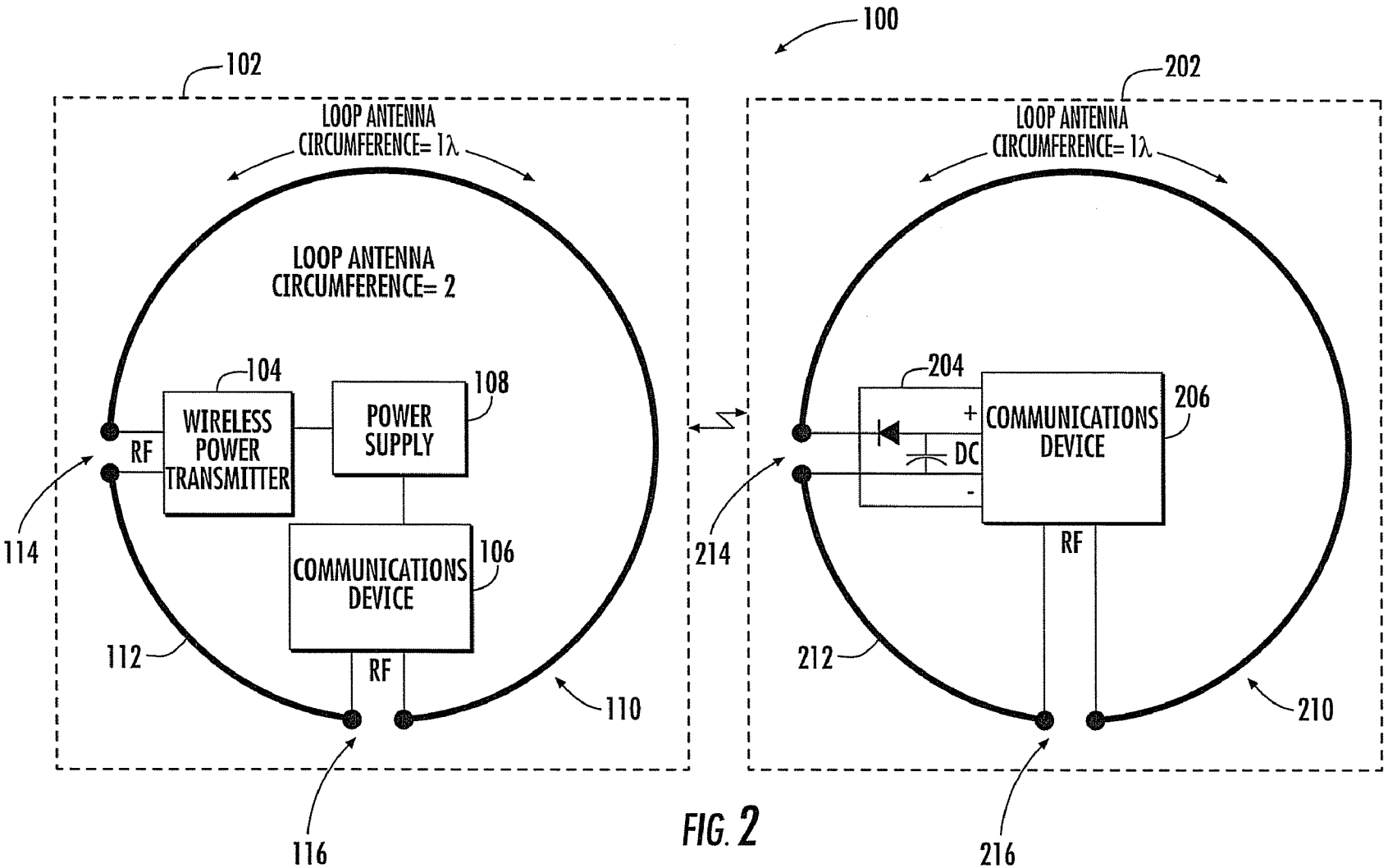
FIG. 2 is a schematic diagram of an embodiment of a system including first and second devices each using the dual polarized loop antenna of FIG. 1.

Referring additionally to FIG. 2, a wireless communication system 100 for data communication and power transmission in accordance with features of the present invention will now be described. The system 100 includes a first device 102, e.g. a radio frequency identification (REID) reader, having a wireless power transmitter 104, a first wireless data communications unit 106, and a first dual polarized loop antenna 110 as discussed above. The wireless power transmitter may be coupled to a power supply 108.

The antenna 110 includes a loop electrical conductor 112 and first and second isolated signal feedpoints 114, 116 along the loop electrical conductor and separated by one quarter of a length of the loop electrical conductor. The wireless power transmitter 104 is coupled to the first isolated signal feedpoint 114 to transmit a power signal having a first polarization (e.g. vertical polarization). The wireless data communications unit 106 is coupled to the second isolated signal feedpoint 116 to communicate using a data signal having a second polarization (e.g. horizontal polarization).

A second device 202, e.g. an RFID tag, is for communications with the first device 102 and includes a second dual polarized loop antenna 210 comprising a loop electrical conductor 212 and first and second isolated signal feedpoints 214, 216 along the loop electrical conductor and separated by one quarter of a length of the loop electrical conductor. A second wireless data communications unit 206 is coupled to the second isolated signal feedpoint 216 of the second dual polarized loop antenna 210 to communicate with the wireless data communications unit 106 of the first device 102 using the data signal having the second polarization. A wireless power receiver 204 (e.g. a power rectifier circuit) is coupled to the first isolated signal feedpoint 214 to receive the power signal having the first polarization from the wireless power transmitter 104 of the first device, and to provide power for the wireless data communications unit 106 of the first device 102.

The first and second dual polarized loop antennas 110, 210 may provide for simultaneous data communication and power transmission between the first and second devices 102, 202.

The approach includes the use of isolated ports and allows simultaneous use of the radio frequency (RF) power and communications link, e.g. in the field of wireless RF identification (RFID) tags. The approach uses a combination of two full wave loop antennas, each antenna having 2 ports which are ¼ wavelength apart and isolated from each other. The features of the system may be advantageously used to address range issues with RFID devices. Although the present invention is directed to RFID transponders, it can also be used to remotely power other communication devices including e.g. remote controls or wireless microphones. The system advantages include real time operation, e.g. power and communications are conveyed simultaneously on the same frequency.

A theory of operation for the dual polarized loop antenna 110 will now be described. Signal feedpoints 14, 16 are separated by unequal distances in the clockwise and counterclockwise directions, corresponding to 90 and 270 degrees phase shifts and a phase difference of 180 degrees. The transposition of forwards and backwards traveling waves from either feedpoint to the other feedpoint results in potentials equal in amplitude but 180 out of phase, and cancellation of the two waves at the opposite feedpoint occurs.

Continuing the theory of operation, the one wavelength circular conductor of dual polarized loop antenna 110 is akin to the one wavelength perimeter of a branch line hybrid coupler (note that although the branch line coupler is frequently printed in a square shape of one wavelength perimeter, it may also of course be printed in a circle of 1 wavelength circumference). Dual polarized loop antenna 110 signal feedpoint 14 is akin to branchline coupler port 4, and dual polarized loop antenna 110 signal feedpoint 16 is akin to branch line coupler port 1. As branch line couplers provide isolation between ports 1 and 4, isolation is similarly provided between polarized loop antenna 110 signal feedpoints 14, 16. The dual polarized loop antenna 110 is of course without physical provision of branch line coupler ports 2 and 3. As dual polarized loop antenna 110 is without the shielding, e.g. ground plane(s) typically used with the branch line coupler, dual polarized loop antenna 110 provides the radiating function of an antenna as well. As background, theory for Branch Line Hybrid Couplers is described in "Hybrid Circuits For Microwaves", W. A. Tyrell, Proceedings of the Institute Of Radio Engineers, November 1947, pp. 1294-1306.

A method aspect is directed to data communication and power transmission between first and second wireless communication devices 102, 202. The method includes providing the first device 102 with a wireless power transmitter 104, a first wireless data communications unit 106, and a first dual polarized loop antenna 110 comprising a loop electrical conductor 112 and first and second isolated signal feedpoints 114, 116 along the loop electrical conductor and separated by one quarter of a length of the loop electrical conductor. The wireless power transmitter 104 is coupled to the first isolated signal feedpoint 114 to transmit a power signal having a first polarization, and the wireless data communications unit 106 is coupled to the second isolated signal feedpoint 116 to communicate using a data signal having a second polarization.

The method includes providing the second device 202 with a second dual polarized loop antenna 210 comprising a loop electrical conductor 212 and first and second isolated signal feedpoints 214, 216 along the loop electrical conductor and separated by one quarter of a length of the loop electrical conductor. A second wireless data communications unit 206 is coupled to the second isolated signal feedpoint 216 of the second dual polarized loop antenna 210 to communicate with the wireless data communications unit 106 of the first device 110 using the data signal having the second polarization. A wireless power receiver 204 is coupled to the first isolated signal feedpoint 214 of the second dual polarized loop antenna 210 to receive the power signal having the first polarization from the wireless power transmitter 104 of the first device 110, and to provide power for the wireless data communications unit 106 of the first device 110.

Wireless power receiver 204 may be a rectifier circuit for the conversion of radio frequency alternating currents into direct current (DC), such as the half wave rectifier circuit illustrated. Full wave or bridge rectifier circuits (not shown) may be used for higher efficiency or higher voltages as needed. Wireless power receiver 204 may also include storage capacitors or storage batteries (not shown) to accumulate and store wireless power over time, and to permit high peak transmit powers from communications device 206.

Figure 3:
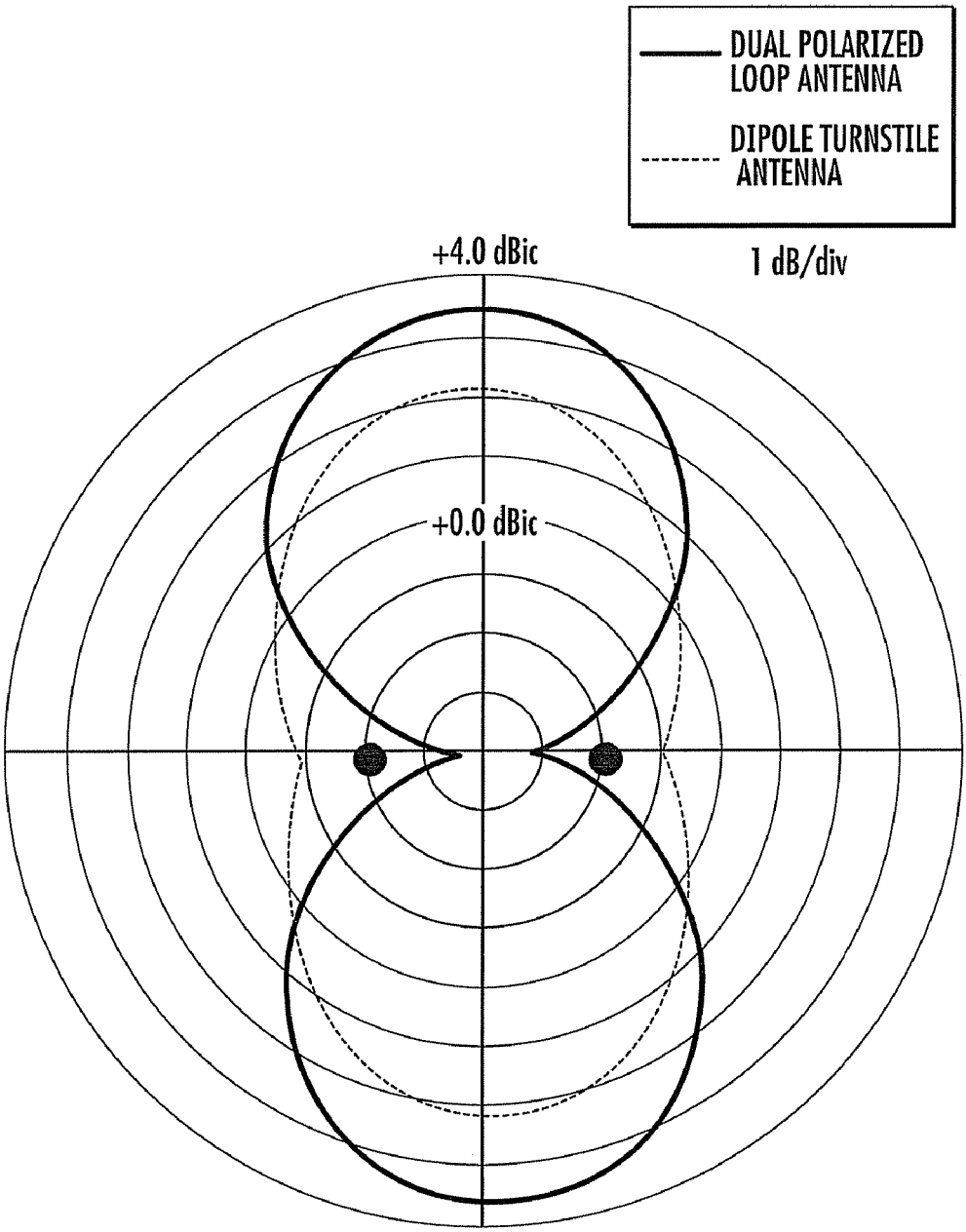
FIG. 3 is a graph depicting an elevation cut far field radiation pattern for the dual polarized loop antenna of FIG. 1, compared with a ½ wave dipole turnstile antenna, mounted in the same plane.

The elevation (XZ plane) cut radiation pattern for the dual polarized loop antenna embodiment of the present invention is compared with that of a conventional ½ wave dipole turnstile antenna in FIG. 3. As can be appreciated, the dual polarized loop antenna has a two petal rose pattern ($\cos^n \theta$), a half power beamwidth near 98 degrees, and a gain of 3.6 dBic compared to 2.1 dBic of a conventional ½ wave dipole turnstile antenna, resulting in an increase of 1.4 dB. This higher gain is obtained in less physical area as well. The azimuth (XY plane) cut radiation pattern (not shown) is nearly omnidirectional, e.g. circular, and has a gain near −3.3 dBi in that plane. Isolation between the antenna port can be infinite in theory and −33 dB has been measured in practice.

Figure 4:
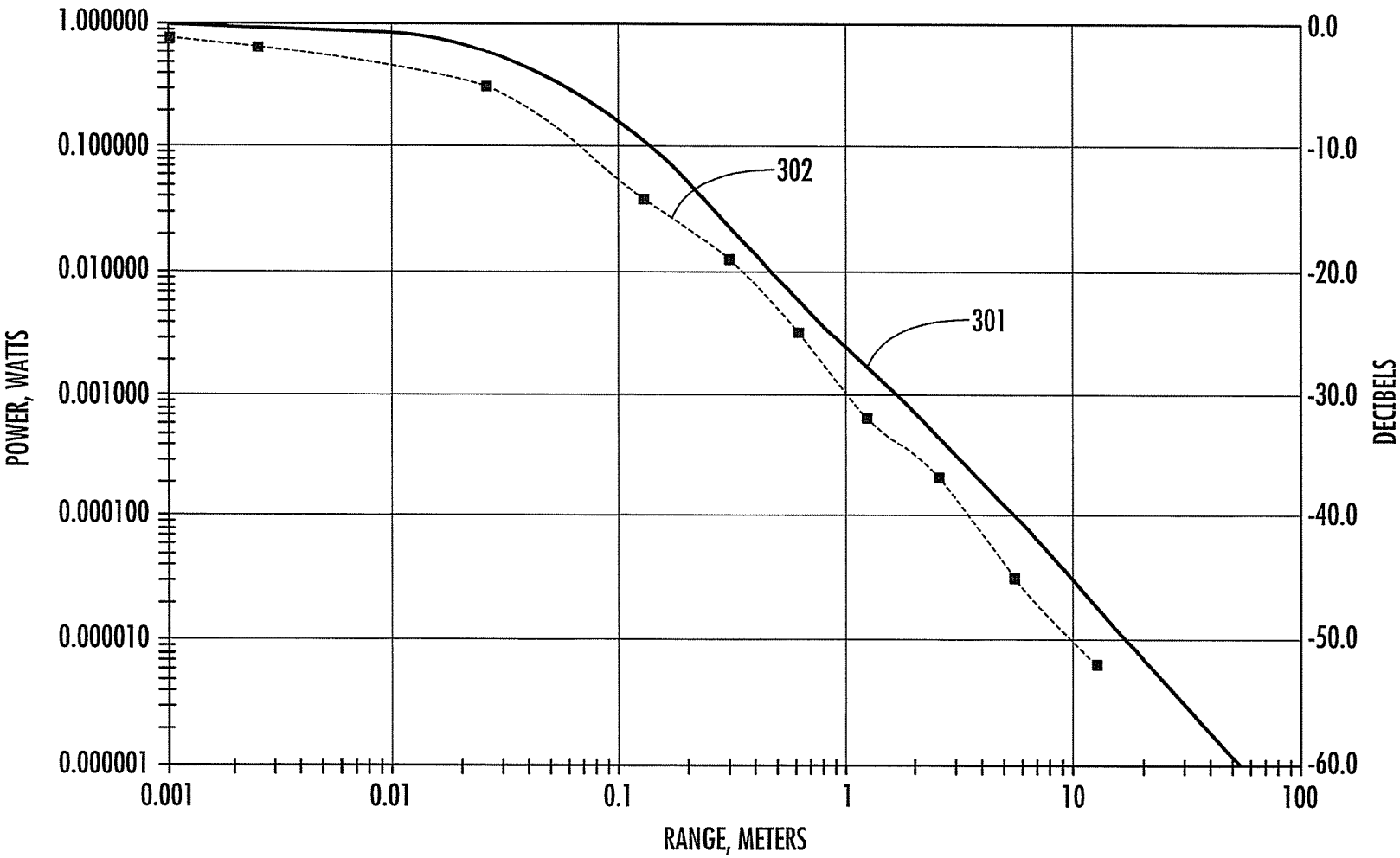
FIG. 4 is a graph of the continuous power conveyed between two units of the present invention loop antenna.

FIG. 4 is a graph of the power conveyed between two dual polarized loop antennas 10, as a function of the range between them. FIG. 3 is for operation at 915 MHz, 1 watt transmitter power, and with antennas aligned for maximum coupling. Calculated trace 301 was obtained by a method of moments simulation in the NEC4.1 Numerical Electromagnetic Code by Lawrence Livermore National Laboratories of Livermore, Calif. Measured trace 302 was obtained by building and testing thin wire prototypes of first and second dual polarized loop antennas 110, 210 in an anechoic chamber.

The measured data indicates slightly higher losses than calculated. This was primarily due to reflection loss due to VSWR: the antennas 110, 210 were operated directly into a 50 ohm system for simplicity, resulting in 2.8 to 1 VSWR and 1.1 dB of reflection loss at each end. As can be seen, the difference between measured and calculated is about 2.2 dB at most ranges which corresponds to the 2(1.1)=2.2 dB reflection loss. The present invention can of course be further matched to avoid this loss or the loss can be taken in trade for convenience or economy. The impedance at series signal feedpoints 14, 16 at resonance may be about Z=130+j0 Ohms.

At ranges beyond about 0.5λ coupling between two dual polarized loop antennas 10 is by radiated far fields, which may be calculated as:

$$P_r = P_t(\lambda/4\pi r)^2 G_t G_r$$

where:

$P_t$=The Power Input Into The Transmit Antenna, Watts

Pr=The Power Extracted From The Receive Antenna, Watts

λ=The Free Space Wavelength In Meters r=The Free Space Range Between The Antennas $G_t$=The Transmit Antenna Gain=$10^{(\text{Transmit Antenna Gain in dBi}/10)}$ $G_t$=The Receive Antenna Gain=$10^{(\text{Receive Antenna Gain in dBi}/10)}$ The above equation assumes perfectly aligned antennas and perfect impedance matching. The squared term, e.g. $(\lambda/4\pi r)^2$ arises from the spherical wave spreading loss for radiated far fields. For the present invention both the transmit and receive antenna gain is about $10^{(3.6/10)}$=2.3.

Exact resonance in the present invention loop antennas occurs at slightly larger than 1 wavelength (λ) nominal circumference. For thin wire loop conductors, of diameter <λ/50, resonance occurs at 1.04λ. This is in reverse to thin wire wave dipoles, where exact resonance may occur at 0.47λ to 0.48λ. Although 1λ nominal circumference is a preferred embodiment for loop antenna 12, the invention may continue to produce dual polarization for smaller loop circumferences.

The preceding discussion has been for series signal sources 18, 20, to be identical in frequency and with a constant phase relationship. Series signal sources 18, 20 my however be operated slightly offset in frequency with only a slight degradation in isolation between ports 14, 16.

The present invention is not so limited as to require discontinuities in the loop conductor at signal feed points 14, 16, and other signal feed approaches may be used, as for example, shunt feeding. The gamma or Y match are suitable shunt feeds, as are common in dipole and yagi-uda antenna practice, and would be appreciated by those skilled in the art.

Inset feed approaches may also be used to form signal feed points 14, 16. For instance, loop electrical conductor 12 may be made of coaxial cable, and the radiating current a common mode current on the outside of a coaxial cable loop. The coax cable braid may be spread, but not severed, to bring the center conductor out at the desired location, and the signal feed points 14, 16 formed by a discontinuity the coaxial cable loops outer conductor. Also, other loop shapes may be substituted in the present invention, with qualitatively similar results. For instance the full wave circular loop may be made square, with ¼ wavelength sides, or even triangular.

Accordingly, a dual polarization loop antenna is provided with an increase in gain and decrease in size. In the antenna according to the present invention there are two isolated feedpoints in series in the loop conductor and dual orthogonal polarizations. Sufficient port isolation may be provided to simultaneous convey wireless power and communications.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A wireless communication system for data communication and power transmission, the system comprising:

a first device including a wireless power transmitter, a first wireless data communications unit, and a first dual polarized loop antenna comprising a first loop electrical conductor and first and second isolated signal feedpoints along the first loop electrical conductor and separated by one quarter of a length of the first loop electrical conductor, the wireless power transmitter being coupled to the first isolated signal feedpoint to transmit a power signal having a first polarization, and the wireless data communications unit being coupled to the second isolated signal feedpoint to communicate using a data signal having a second polarization; and a second device for communications with the first device and including a second dual polarized loop antenna comprising a second loop electrical conductor and first and second isolated signal feedpoints along the second loop electrical conductor and separated by one quarter of a length of the second loop electrical conductor, a second wireless data communications unit coupled to the second isolated signal feedpoint of the second dual polarized loop antenna to communicate with the wireless data communications unit of the first device using the data signal having the second polarization, and a wireless power receiver coupled to the first isolated signal feedpoint of the second dual polarized loop antenna to receive the power signal having the first polarization from the wireless power transmitter of the first device, and to provide power for the second device.

2. The wireless communication system according to claim 1, wherein the first and second dual polarized loop antennas provide for simultaneous data communication and power transmission between the first and second devices.

3. The wireless communication system according to claim 1, wherein the first and second isolated signal feedpoints along the loop electrical conductor of each of the first and second dual polarized loop antennas are operated at a signal feedpoint phase angle input difference of 0 degrees.

4. The wireless communication system according to claim 1, wherein each of the first and second isolated signal feedpoints of each of the first and second dual polarized loop antennas defines a discontinuity in the respective first and second loop electrical conductors.

5. The wireless communication system according to claim 1, wherein each of the first and second loop electrical conductors comprises a circular electrical conductor.

6. The wireless communication system according to claim 1, wherein each of the first and second dual polarized loop antennas comprises a dual linearly polarized loop antenna.

7. The wireless communication system according to claim 1, wherein the first device defines a radio frequency identification (RFID) reader, and the second device defines an RFID tag.

8. A wireless communication device for data communication and power transmission, the device comprising:

a wireless power transmitter;

a wireless data communications unit; and a dual polarized loop antenna comprising a loop electrical conductor and first and second isolated signal feedpoints along the loop electrical conductor and separated by one quarter of a length of the loop electrical conductor;

the wireless power transmitter being coupled to the first isolated signal feedpoint to transmit a power signal having a first polarization, and the wireless data communications unit being coupled to the second isolated signal feedpoint to communicate using a data signal having a second polarization.

9. The wireless communication device according to claim 8, wherein the dual polarized loop antenna provides for simultaneous data communication and power transmission.

10. The wireless communication device according to claim 8, wherein each of the first and second isolated signal feedpoints of the dual polarized loop antenna defines a discontinuity in the loop electrical conductor.

11. The wireless communication device according to claim 8, wherein the loop electrical conductor comprises a circular electrical conductor.

12. The wireless communication device according to claim 8, wherein the device defines a radio frequency identification (RFID) reader.

13. A wireless communication device for data communication and power reception, the device comprising:

a dual polarized loop antenna comprising a loop electrical conductor and first and second isolated signal feedpoints along the loop electrical conductor and separated by one quarter of a length of the loop electrical conductor;

a wireless power receiver coupled to the first isolated signal feedpoint of the dual polarized loop antenna to receive a power signal having a first polarization, and to provide power for the device; and a wireless data communications unit coupled to the second isolated signal feedpoint of the dual polarized loop antenna to communicate using a data signal having a second polarization.

14. The wireless communication device according to claim 13, wherein the dual polarized loop antenna provides for simultaneous data communication and power transmission.

15. The wireless communication device according to claim 13, wherein each of the first and second isolated signal feedpoints of the dual polarized loop antenna defines a discontinuity in the loop electrical conductor.

16. The wireless communication device according to claim 13, wherein the loop electrical conductor comprises a circular electrical conductor.

17. The wireless communication device according to claim 13, wherein the device defines a radio frequency identification (RFID) tag.

18. A method for data communication and power transmission between first and second wireless communication devices, the method comprising:

operating the first device including a wireless power transmitter, a first wireless data communications unit, and a first dual polarized loop antenna comprising a loop electrical conductor and first and second isolated signal feedpoints along the loop electrical conductor and separated by one quarter of a length of the loop electrical conductor, the wireless power transmitter being coupled to the first isolated signal feedpoint and transmitting a power signal having a first polarization, and the wireless data communications unit being coupled to the second isolated signal feedpoint and communicating using a data signal having a second polarization; and operating the second device including a second dual polarized loop antenna comprising a loop electrical conductor and first and second isolated signal feedpoints along the loop electrical conductor and separated by one quarter of a length of the loop electrical conductor, a second wireless data communications unit coupled to the second isolated signal feedpoint of the second dual polarized loop antenna and communicating with the wireless data communications unit of the first device using the data signal having the second polarization, and a wireless power receiver coupled to the first isolated signal feedpoint of the second dual polarized loop antenna and receiving the power signal having the first polarization from the wireless power transmitter of the first device, and providing power for the second device.

19. The method according to claim 18, wherein data communication and power transmission is simultaneous.

20. The method according to claim 18, further comprising operating the first and second isolated signal feedpoints along the loop electrical conductor of each of the first and second dual polarized loop antennas at a signal feedpoint phase angle input difference of 0 degrees.

21. The method according to claim 18, wherein operating the first device is for a radio frequency identification (RFID) reader function; and wherein operating the second device comprises is for an RFID tag function.

* * * * *